US007474209B2

(12) United States Patent
Marsilio et al.

(10) Patent No.: US 7,474,209 B2
(45) Date of Patent: Jan. 6, 2009

(54) CABLE ALARM SECURITY DEVICE

(75) Inventors: Ronald M. Marsilio, Lake Wiley, SC (US); Christopher J. Fawcett, Charlotte, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 427 days.

(21) Appl. No.: 11/315,052

(22) Filed: Dec. 22, 2005

(65) Prior Publication Data

US 2006/0170550 A1 Aug. 3, 2006

Related U.S. Application Data

(60) Provisional application No. 60/644,193, filed on Jan. 14, 2005.

(51) Int. Cl.
*G08B 13/14* (2006.01)

(52) U.S. Cl. ..... 340/568.1; 340/568.2; 340/568.4; 340/571; 340/572.1; 340/572.8; 340/572.9

(58) Field of Classification Search ..... 340/568.1, 340/568.2, 568.4, 571, 572.1, 572.8, 572.9
See application file for complete search history.

(56) References Cited

U.S. PATENT DOCUMENTS

| | | | |
|---|---|---|---|
| 199,468 | A | 1/1878 | Rheubottom |
| 596,237 | A | 12/1897 | Damon |
| 639,196 | A | 12/1899 | Fehling |
| 673,612 | A | 5/1901 | Appleby |
| 886,905 | A | 5/1908 | Ward |
| 895,403 | A | 8/1908 | Jackson |
| 1,012,882 | A | 12/1911 | Austin et al. |
| 1,083,612 | A | 1/1914 | Hooker |
| 1,124,130 | A | 1/1915 | Grant |
| 1,141,245 | A | 6/1915 | Gillespie |
| 1,165,320 | A | 12/1915 | Clary |
| 1,165,816 | A | 12/1915 | Tichenor |
| 1,601,493 | A | 9/1926 | Condon |
| 1,657,190 | A | 1/1928 | Ballou |
| 2,002,946 | A | 5/1935 | Jacobs |
| 3,214,808 | A | 11/1965 | Litwin |

(Continued)

FOREIGN PATENT DOCUMENTS

| | | |
|---|---|---|
| DE | 2725580 | 12/1977 |

(Continued)

*Primary Examiner*—George A Bugg
*Assistant Examiner*—Travis R Hunnings
(74) *Attorney, Agent, or Firm*—Sand & Sebolt

(57) ABSTRACT

A security device for attachment to an article to deter theft of the article has a housing containing an alarm system including an audible alarm and an LED. A cable has one end attached to the housing and a second end attached to a plug which is selectively inserted into and locked to the housing. The cable includes a conductor electrically connected to the alarm system when in the locked position. The audible alarm is activated if the integrity of the cable is compromised. An EAS tag located in the housing will actuate an alarm at a security gate and can actuate the audible alarm of the security device when the device is in proximity to a security gate. The LED is positioned in the housing to be visible from both sides of the housing. A magnetically attractable lock mechanism releasably secures the cable plug in the locked position.

22 Claims, 9 Drawing Sheets

U.S. PATENT DOCUMENTS 3,395,555 A 8/1968 Hickman
3,466,668 A 9/1969 Ochiai
3,611,760 A 10/1971 Muther
3,636,739 A 1/1972 Smedley
3,754,420 A 8/1973 Oellerich
3,831,407 A 8/1974 Coleman
3,872,547 A 3/1975 Caveney et al.
3,906,758 A 9/1975 Hurwitt
4,070,879 A 1/1978 Thompson
4,071,023 A 1/1978 Gregory
4,086,795 A 5/1978 Foster et al.
4,128,220 A 12/1978 McNeel
4,191,334 A 3/1980 Bulanda et al.
4,196,424 A 4/1980 Williamson
4,287,644 A 9/1981 Durand
4,299,870 A 11/1981 Humble
4,418,551 A 12/1983 Kochackis
4,499,680 A 2/1985 Coburn
4,500,124 A 2/1985 Swift
4,506,415 A 3/1985 Swift
4,580,319 A 4/1986 Paradis
4,620,182 A 10/1986 Keifer
4,631,782 A 12/1986 Gecs
4,708,306 A 11/1987 Mitomi
4,736,604 A 4/1988 Zeller et al.
4,756,171 A 7/1988 Homar
4,776,188 A * 10/1988 Dalaba et al. ..... 70/49
4,813,105 A 3/1989 Espinoza
4,823,442 A 4/1989 Behr
4,825,156 A 4/1989 Read
4,833,807 A 5/1989 McLean
4,893,853 A 1/1990 Guiler
4,896,517 A 1/1990 Ling
4,897,899 A 2/1990 Shely et al.
4,919,373 A 4/1990 Caveney et al.
4,929,006 A * 5/1990 Tsay ..... 292/324
4,930,324 A 6/1990 Meier
4,944,475 A 7/1990 Ono et al.
4,949,679 A 8/1990 Wolfer
4,958,414 A 9/1990 Benoit
4,962,369 A * 10/1990 Close ..... 340/568.1
5,042,114 A 8/1991 Parrish
5,062,807 A 11/1991 Guss, III
5,068,643 A 11/1991 Yashina
5,079,540 A 1/1992 Narlow et al.
5,119,652 A 6/1992 Costa
5,121,524 A 6/1992 Mortensen
5,123,686 A 6/1992 Wenk
5,144,820 A 9/1992 Holmgren
5,144,821 A 9/1992 Ernesti et al.
5,156,028 A 10/1992 Jiang
5,193,368 A 3/1993 Ling
5,230,541 A 7/1993 Nowak
5,279,136 A 1/1994 Perry
5,293,668 A 3/1994 Tibiletti
5,337,459 A 8/1994 Hogan
5,337,503 A 8/1994 Goby
5,345,947 A 9/1994 Fisher
5,377,388 A 1/1995 DeBever
5,379,496 A 1/1995 Krauss
5,413,393 A 5/1995 Georgopoulos et al.
5,421,177 A 6/1995 Sieber et al.
5,431,393 A 7/1995 Wang
5,437,172 A 8/1995 Lamy et al.
5,440,904 A 8/1995 Su
5,517,835 A 5/1996 Smith
5,517,836 A 5/1996 Hong
5,524,463 A 6/1996 Schenkel et al.
5,551,447 A 9/1996 Hoffman et al.
5,565,848 A * 10/1996 Leyden et al. ..... 340/568.2
5,568,951 A 10/1996 Morgan
5,570,080 A 10/1996 Inoue et al.
5,581,853 A 12/1996 Miller et al.
5,589,819 A 12/1996 Takeda
5,610,587 A * 3/1997 Fujiuchi et al. ..... 340/568.2
5,627,520 A 5/1997 Grubbs et al.
5,671,506 A 9/1997 Eliasson
5,687,455 A 11/1997 Alexander
5,687,456 A 11/1997 Chang
5,722,266 A 3/1998 Yeager et al.
5,764,147 A 6/1998 Sasagawa et al.
5,767,773 A * 6/1998 Fujiuchi et al. ..... 340/571
5,794,464 A 8/1998 Yeager et al.
5,844,484 A * 12/1998 Fujiuchi et al. ..... 340/572.1
5,850,752 A 12/1998 Lax
5,856,782 A * 1/1999 Sasagawa et al. ..... 340/572.9
5,864,290 A * 1/1999 Toyomi et al. ..... 340/572.9
5,951,047 A 9/1999 Dungan
5,959,532 A * 9/1999 Fujiuchi et al. ..... 340/572.3
5,969,613 A 10/1999 Yeager et al.
6,020,819 A * 2/2000 Fujiuchi et al. ..... 340/571
6,052,876 A 4/2000 Hogan et al.
6,092,401 A 7/2000 Sankey et al.
6,128,932 A 10/2000 Mainetti et al.
6,140,923 A * 10/2000 Lam ..... 340/568.7
6,177,869 B1 * 1/2001 McDaid ..... 340/568.1
6,227,016 B1 5/2001 Yu
6,363,758 B1 4/2002 Ling
6,420,971 B1 * 7/2002 Leck et al. ..... 340/542
6,422,387 B1 7/2002 Sedon et al.
6,425,780 B1 7/2002 Muhlmichel
6,449,991 B1 9/2002 Hogan
6,523,228 B1 2/2003 Benoit
6,624,753 B2 9/2003 Elston
6,731,212 B2 * 5/2004 Hirose et al. ..... 340/572.9
6,755,055 B2 * 6/2004 Sedon et al. ..... 70/57.1
7,135,973 B2 * 11/2006 Kittel et al. ..... 340/568.2
7,227,467 B2 * 6/2007 Feibelman ..... 340/568.2
7,239,238 B2 * 7/2007 Tester et al. ..... 340/539.31
7,342,495 B2 * 3/2008 Sayegh ..... 340/572.1
2002/0158762 A1 * 10/2002 Nguyen et al. ..... 340/572.9
2006/0220848 A1 * 10/2006 Tropper ..... 340/568.1
2007/0120669 A1 * 5/2007 Belden, Jr. ..... 340/568.2
2007/0236353 A1 * 10/2007 Marsilio et al. ..... 340/572.1

FOREIGN PATENT DOCUMENTS

SE 123470 11/1948
WO WO 03/072896 9/2003

* cited by examiner

CABLE ALARM SECURITY DEVICE

CROSS REFERENCE TO RELATED APPLICATION

This application claims the benefit of U.S. Provisional Patent Application Ser. No. 60/644,193, filed Jan. 14, 2005.

BACKGROUND OF THE INVENTION

1. Technical Field

The invention relates to theft deterrent devices, and particularly to an EAS tag carrying device that is secured to an item to deter theft thereof. More particularly, the invention relates to such a security device that is connected to an item of merchandise by a cable which is locked thereon by a magnetically attractable locking mechanism, and which has an internal alarm which is actuated if the integrity of the cable is compromised and upon the secured item approaching a security gate sensor.

2. Background Information

Various retail establishments use theft deterrent systems and devices to discourage shoplifting. Many of these theft deterrent devices use electronic article surveillance (EAS) tags attached to the item of merchandise. The tags are configured to activate an alarm of a security gate that is located at the exit of the retail establishment. Securing the EAS tag to merchandise is a problem faced by many retail establishments. The tags must be connected in a secure manner that prevents unauthorized removal while not damaging the items of merchandise. Also, the tags must be readily removable by authorized personnel so that the tags do not unduly delay checkout and inadvertently actuate the security gate alarm.

The prior art is replete with EAS tag carriers designed to secure the tags to merchandise. Various types are known in which frames extend around the items, pins pierce the items, and cables wrap around the items. The present invention relates to the type of security devices that use cables to wrap around or through a portion of the merchandise.

Many of these types of cable devices are large and bulky and require complicated mechanical mechanisms to lock and unlock the cable from the device for subsequent removal from the item of merchandise. Furthermore, the alarms contained in some of the prior art devices are actuated only if the cable is severed and/or broken away from the device, but will not sound the alarm if the merchandise having the security item attached thereto is removed in its entirety. Even though the EAS tag could actuate a different alarm at a security gate upon passing through the gate, this does not always prove satisfactory due to the sensitivity of the gate which must be tuned to numerous security devices used throughout the store. Also once the stolen item of merchandise having the security device still attached thereto leaves the store premises, the thief can easily disappear in a crowd or parking lot and the store alarm only alerts the store personnel that an item of merchandise has been stolen.

The subject invention solves many of these problems by providing a device which is of a relatively inexpensive construction, yet is easily applied and removed from the protected item of merchandise, and which provides a versatile alarm system contained within the housing.

BRIEF SUMMARY OF THE INVENTION

One aspect of the present invention is to provide a cable alarm security device which is easily placed about an item of merchandise to be protected thereby and easily removed therefrom at the checkout station, and which is reusable numerous times on various items of merchandise requiring only a small opening for passage of a locking member and cable therethrough.

Another aspect of the invention is that the cable forms a loop when locked to a housing which is used to secure the device on the merchandise, and in which the cable can be of various thicknesses and types containing either one or two electrical conductors for protecting the cable by connecting it to an internal alarm system secured within the housing of the security device.

Still another aspect of the invention is to provide such a security device in which the alarm system includes an LED which is visible from both sides of the housing by use of a lens in a rounded end wall of the housing or in two opposed openings formed in side walls of the housing, thereby increasing its visibility to the store personnel and to advise a potential shoplifter that an alarm is activated.

A further feature of the invention is to provide the internal alarming system with an EAS tag which will actuate an internal audible alarm contained within the housing upon the security device coming into proximity with a security gate alarm system, in addition to actuating the security gate alarm, and in which the internal audible alarm of the security device will remain actuated even upon the thief leaving the store with a stolen item of merchandise.

Another feature of the present invention is to enable the length of the cable to extend throughout a relatively large range thereby making it adaptable for use with various items of merchandise, and in which the locking mechanism includes a magnetically attractable lock device easily opened only when a pair of magnets are aligned with a pair of locking tines to reduce the risk of a potential shoplifter opening the device with only a single magnet.

These features are obtained by the cable alarm security device of the present invention, the general nature of which may be stated as including a housing; a flexible cable having first and second ends, the first end being connected to the housing and the second end being connected to a plug, wherein the plug is selectively connectable to and removable from the housing; a magnetically actuated locking mechanism mounted in the housing engagable with the plug and moveable between locked and unlocked positions to lock the plug to the housing; and an alarm system mounted within the housing and operatively connected to the cable to sound an audible alarm contained within the housing when the integrity of the cable is compromised or upon the security device approaching a security gate.

BRIEF DESCRIPTION OF THE SEVERAL VIEWS OF THE DRAWINGS

Preferred embodiments of the invention, illustrative of the best modes in which Applicant contemplates applying the principles, are set forth in the following description and are shown in the drawings and are particularly and distinctly pointed out and set forth in the appended claims.

Similar numbers refer to similar parts throughout the drawings.

DETAILED DESCRIPTION OF THE INVENTION

Figure 1:
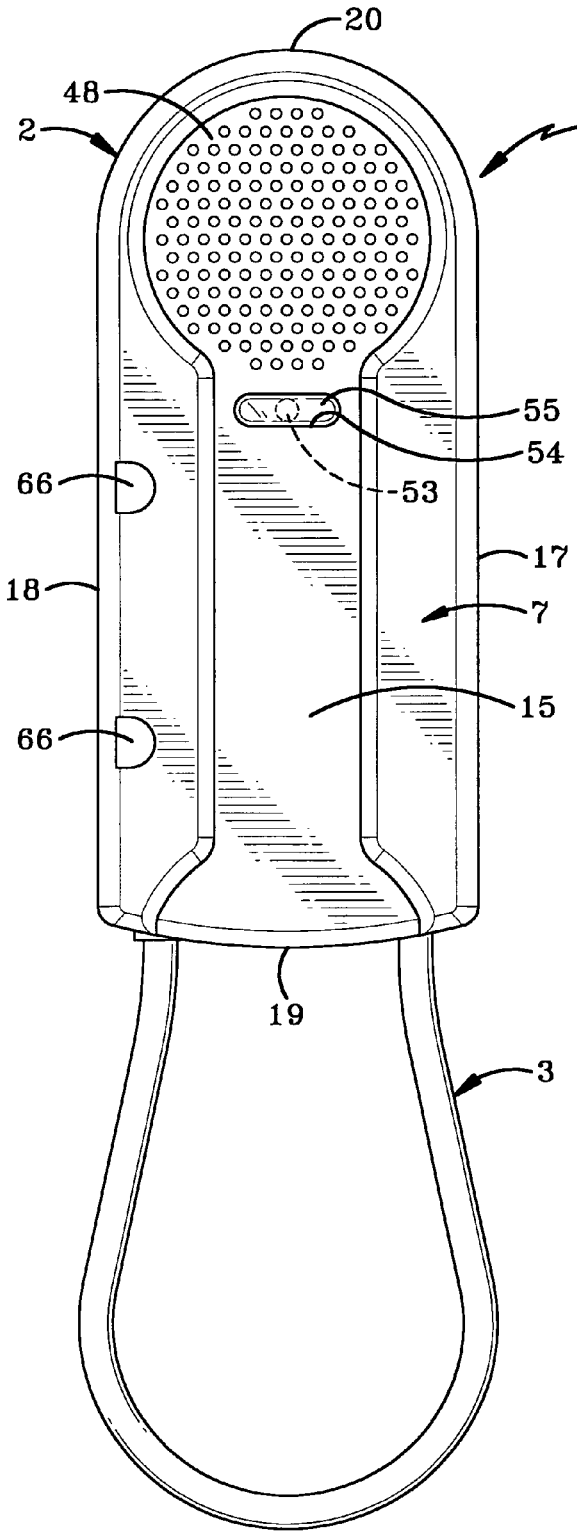
FIG. 1 is a plan view of a first embodiment of the cable alarm security device of the present invention.
Figure 2:
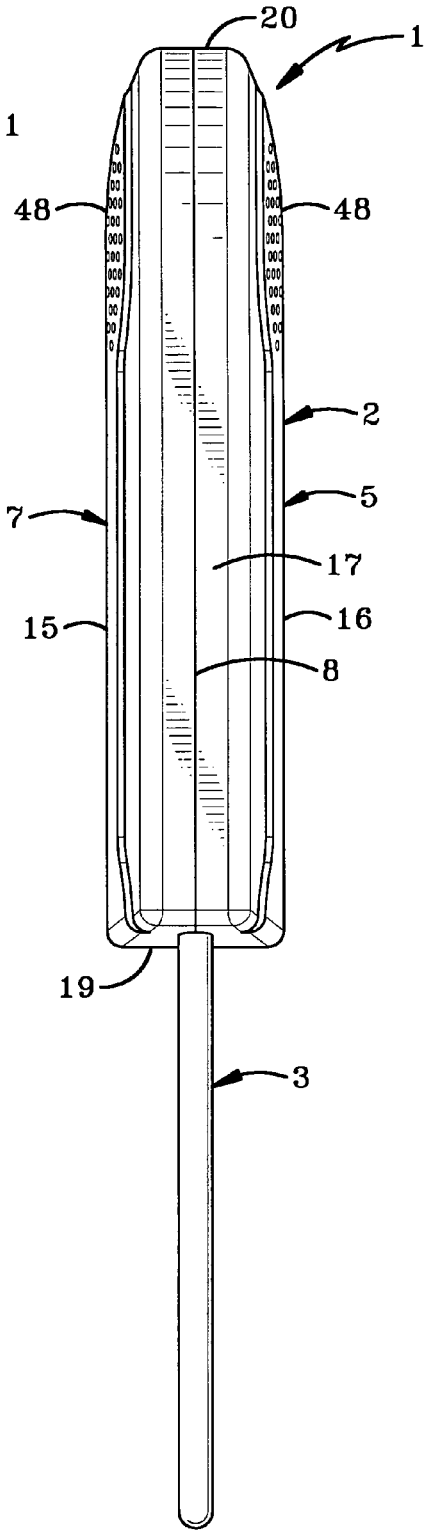
FIG. 2 is a right side elevational view of the security device of FIG. 1.
Figure 3:
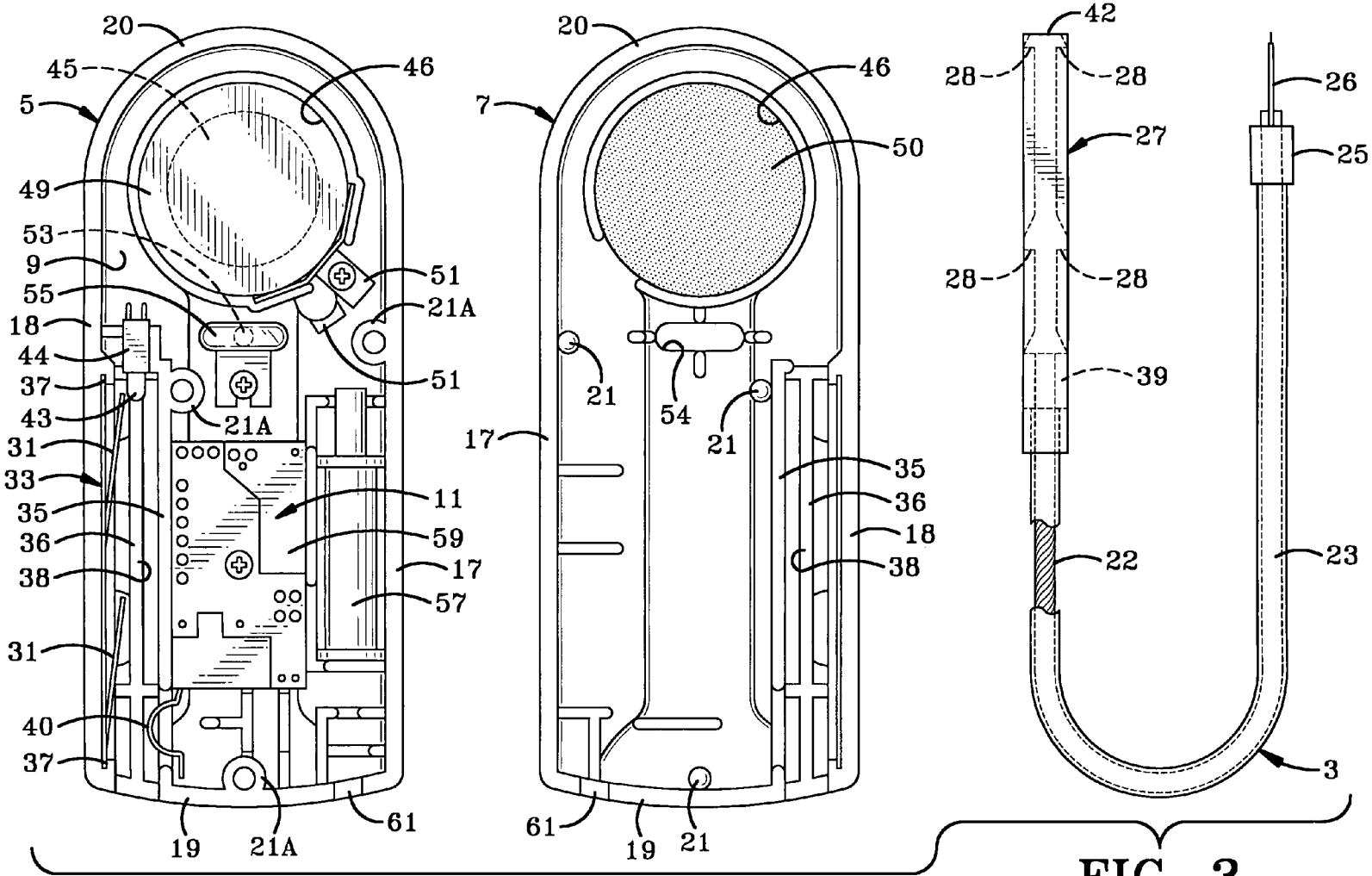
FIG. 3 is an exploded plan view of the security device of FIGS. 1 and 2.

A first embodiment of the cable alarm security device of the present invention is indicated generally at 1, and is shown in FIGS. 1-6. Device 1 includes a main housing 2 and a locking cable 3. Housing 1, as shown in FIG. 3, includes two generally half body components indicated generally at 5 and 7, which are secured together such as with an adhesive or sonic weld, along a seam 8 which extends in a continuous manner completely about the housing as shown in FIGS. 1 and 2. Housing components 5 and 7 preferably are molded of a rigid plastic material and form a hollow internal chamber 9 in which is mounted an alarm system indicated generally at 11 (FIG. 3), the details of which are discussed further below, and a lock mechanism indicated generally at 13.

Housing 2 has a relatively elongated relatively flat configuration as shown In FIGS. 1 and 2, wherein the thickness (FIG. 2) is considerably less than its length (FIG. 1). This provides a relatively compact yet pleasingly attractive device. Housing 1 includes a pair of spaced side walls 15 and 16, spaced edge walls 17 and 18, and a pair of opposed spaced end walls 19 and 20. As discussed above, connecting seam 9 will extend continuously along edge walls 17 and 18 and end walls 19 and 20 when the two half body members 5 and 7 are joined together as shown in FIGS. 1 and 2. Housing member 7 has three positioning posts 21 which extend into three bosses 21A formed on housing member 5 to properly align the members together before final joinder thereof.

Locking cable 3 is best shown in FIG. 3 and includes an internal spirally-wrapped electrically conductive cable 22 covered by a dielectric installation 23. Internal conductor 22 provides both the electrical path for a cable sensing loop as well as the mechanical strength for the cable. Cable 3 terminates at one end with a connector 25, preferably having a rounded barrel-like configuration and formed of an electrically conductive metal, which when secured to the cable is in electrical contact with conductor 22. A conductor 26 is attached to and extends from connector 25 for electrically connecting the cable to alarm system 11. A locking plug indicated generally at 27, is secured to the other end of cable 3. Locking plug 27 preferably is formed of a dielectric plastic material and has at least a pair of locking shoulders 28 formed thereon, (FIG. 4), which when in the locked position engage a pair of spring biased metal tines 31. The term "locked" is used in this application to mean that a key is required to change the state from locked to unlocked to distinguish from a latched connection between two elements where a key is not required to undo the connection.

Figure 4:
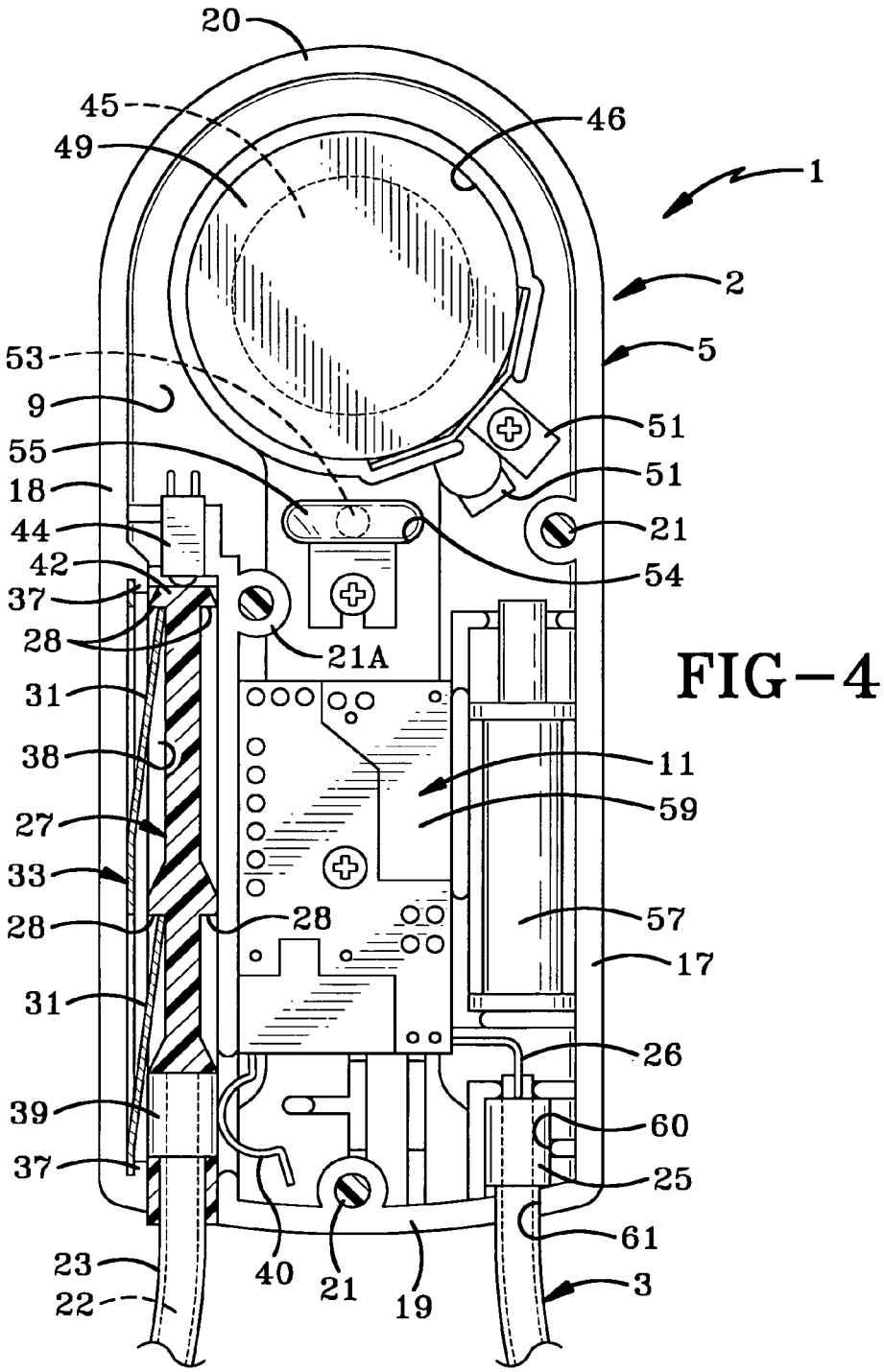
FIG. 4 is a plan view of the housing of the security device containing the alarm system components therein with the locking plug in a locked position.
Figure 4A:
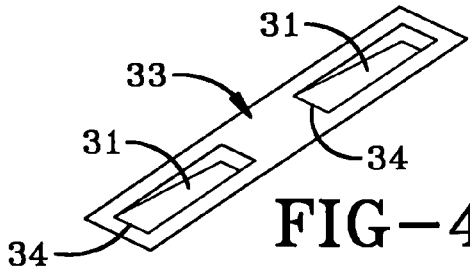
FIG. 4A is a perspective view of the magnetically attractable locking member of the lock mechanism removed from the housing of FIG. 4.
Figure 5:
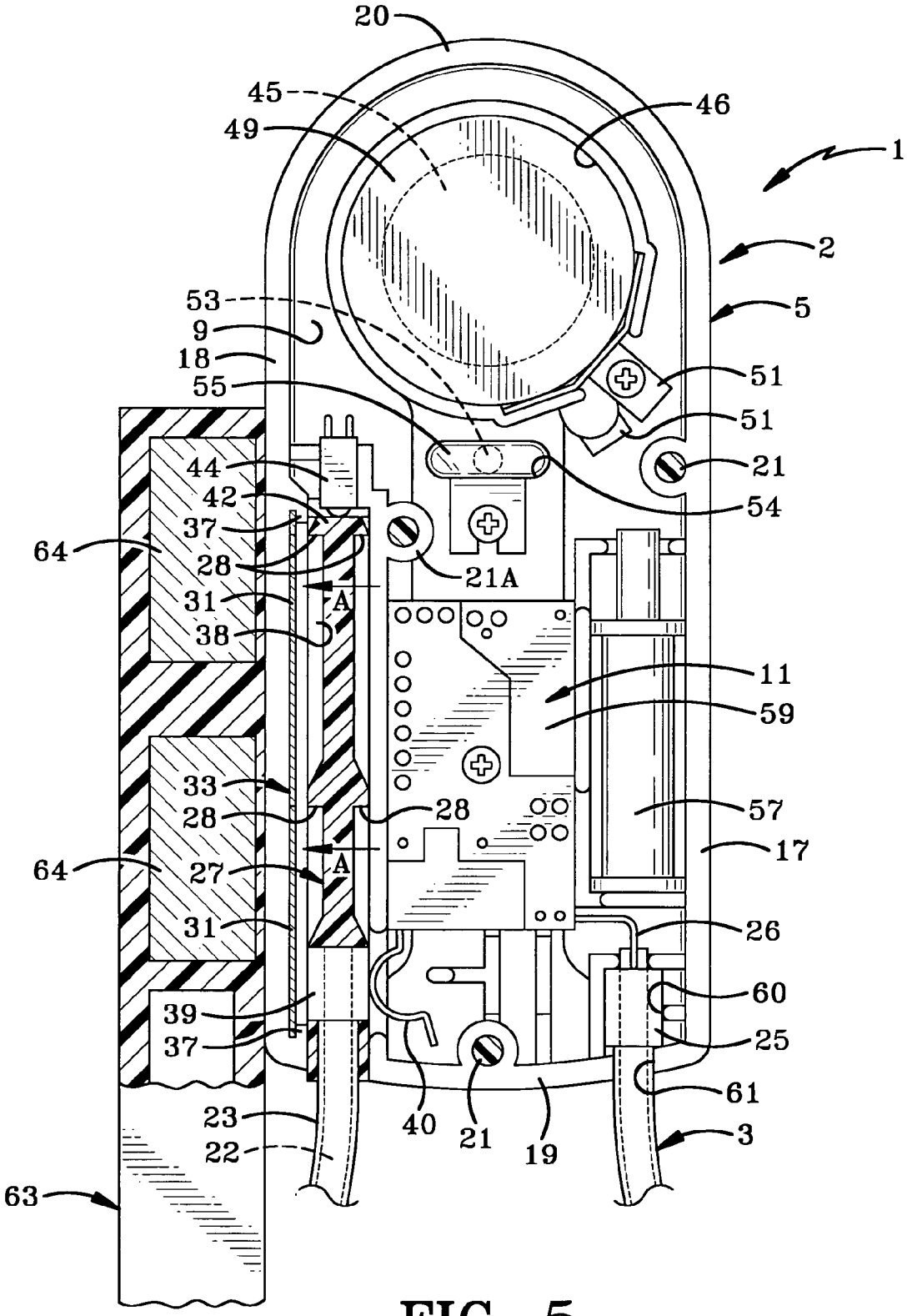
FIG. 5 is a view similar to FIG. 4 showing a magnetic key moving the locking member of FIG. 4A to the unlocked position.

Tines 31 preferably are lanced from a flat spring metal strip of material 33 (FIG. 4A) so as to extend in an outwardly direction as shown in FIG. 4. Tines 31 are integrally connected to strip 33 by hinge segments 34 in order to be easily moved to their original position along and as a part of strip 33, as shown in FIG. 5. Metal strip 33 is secured within housing 2 by extending into slotted openings formed by a pair of tabs 37 as shown in FIG. 4, whereby tines 31 extend into a locking channel 38 formed in housing 2. Locking channel 38 is formed between edge wall 18 and ribs 35 which extend parallel with and spaced from wall 18. Another rib 36 is formed on side walls 15 and 16 and extend along and assist in forming locking channel 38 for securely retaining plug 27 therein.

Figure 6:
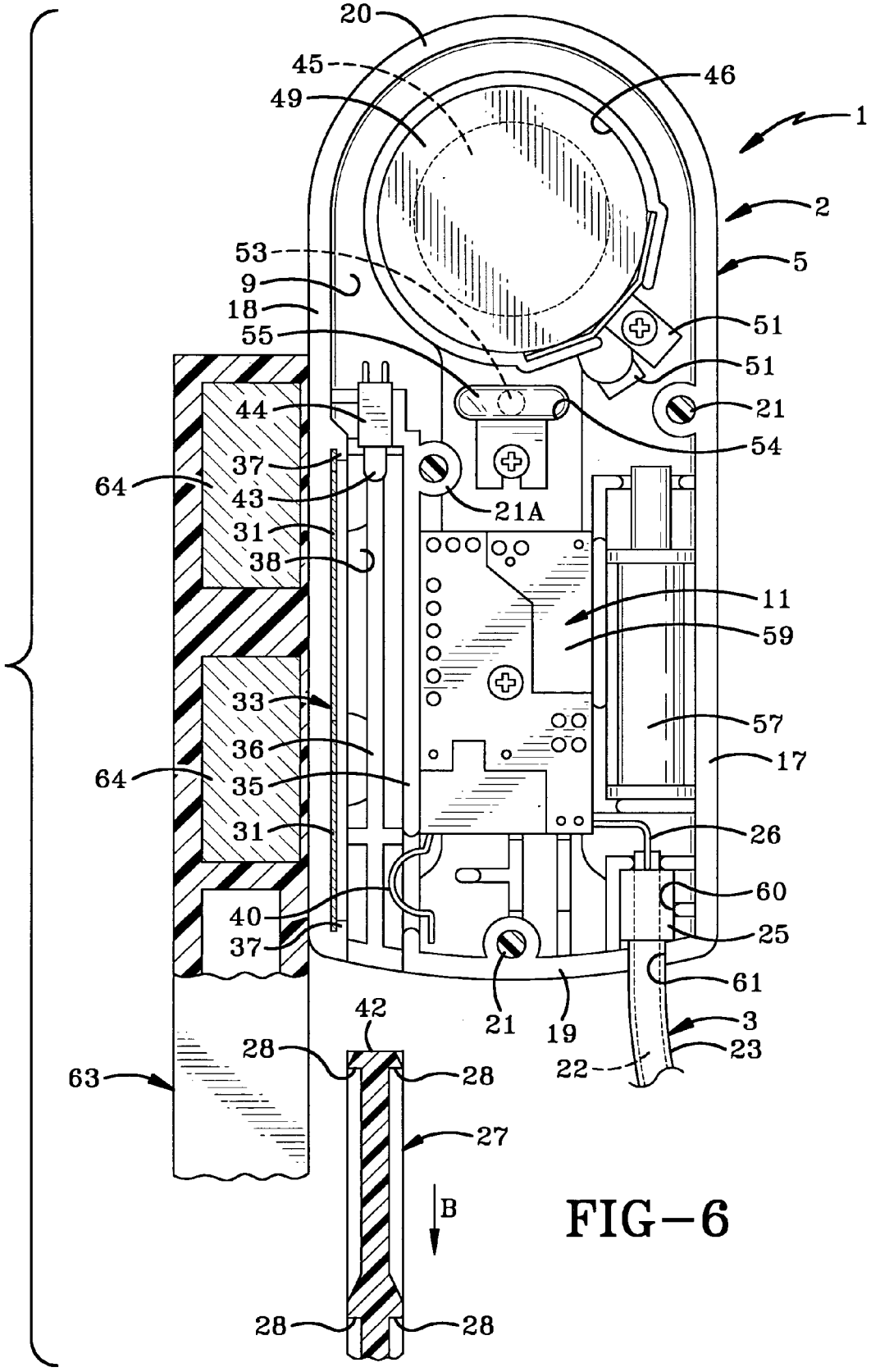
FIG. 6 is a view similar to FIG. 5 with the locking plug removed from the housing.

Locking plug 27 has a generally elongated rectangular configuration, and has two pairs of locking shoulders 28 formed on opposite sides thereof as shown in FIGS. 4, 5, and 6. This enables the plug to be inserted into locking channel 38 in either of two directions facilitating the locking of cable 3 about an article of merchandise. As can be seen in FIG. 4, locking plug 27 could be rotated 180° and inserted into locking channel 38 and still be locked therein by tines 31.

A second metal crimp connector 39 similar to connector 25, is crimped to the other end of cable 3 and is connected to the internal alarming system 11 when in the locked position by engaging a spring metal clip 40, which is electrically connected to the internal alarm system. As shown in FIG. 4, connector 25 on one end of cable 3 is electrically connected to the alarm system through attached conductor 26 and at the opposite end by crimp connector 39 being in electrical contact with metal clip 40, which is electrically connected to the alarm system, thus completing an electrical circuit or sense loop through cable 3. Also, when plug 27 is in the locked position as shown in FIG. 4, the distal end 42 thereof will engage and compress a plunger 43 of a plunger switch 44 from its open position of FIG. 6 to the closed position of FIGS. 4 and 5. Plunger switch 44 is electrically connected in the circuitry of alarm system 11 and will complete a circuit to an audible alarm 45 located within housing 2. Audible alarm 45 is mounted in a circular boss 46 located adjacent a pair of perforated areas 48 formed in the upper portions of side walls 15 and 16, which form opposed grill-like portions of the housing. A battery 49 is also mounted in circular boss 46 (FIG. 3) and covered by a foam pad 50. Battery 49 supplies the electrical power for alarm system 11 through terminals 51.

An LED 53 is mounted within chamber 9 of housing 2 and is electrically connected to battery 49 and is located adjacent a pair of opposed aligned openings 54 formed in housing side walls 15 and 16, in which may be mounted lenses 55. LED 53 preferably will provide a blinking light when the alarm system is activated, which will be readily visible from both sides of the housing by store personnel as well as potential shoplifters to advise them that an alarm system is activated, further protecting the item of merchandise to which device 1 is attached from theft.

An EAS tag 57 is located within chamber 9 of housing 2 and can have various configurations, such as the coil configuration as shown in FIGS. 3-6. Tag 57 preferably is a magnetically sensitive device or an RF (radio) sensitive device, which are the two most common forms of EAS tags and associated sensing systems used today. EAS tag 57 will actuate internal audible alarm 43 by receiving signals from a secured gate, as discussed further below, as well as actuating the security gate alarm as do most EAS tags contained within a secured device.

Alarm system 11 includes a solid state circuit board 59, which is mounted on housing member 5 (FIGS. 3 and 4) and preferably is of the type shown and described in detail in pending Provisional Patent Application filed Dec. 28, 2004, the contents of which are incorporated herein.

As shown in FIG. 4, cable end connector 25 is mounted permanently within housing 2 and is seated within a compartment 60 formed in a lower corner of housing 2 with cable 3 entering the housing through a circular opening 61 formed in end wall 19. Locking plug 27 is shown in a locked position in FIG. 4 with the distal ends of spring biased tines 31 engaged with shoulders 28 preventing the removal of plug 27 from locking channel 38. In this position, plunger switch 44 is actuated, as well as the electrical connection made with alarm system 11 through spring biased clip 40.

To unlock the locking mechanism of security device 1 (FIG. 5), a magnetic key indicated generally at 63, is used to move metal tines 31 from their locked position of FIG. 4 to the unlocked position of FIG. 5 by attracting them in the direction of Arrows A (FIG. 5). Key 63 preferably contains a pair of internal magnets 64 which are positioned at a certain location therein so as to accurately align with tines 31 in order to exert a sufficiently large magnetic attraction thereon for their movement to the unlocked position. A pair of alignment notches 66 are formed on both housing side walls 15 and 16 to align with positioning tabs (not shown) formed on magnetic key 63 to ensure that magnets 64 properly align with tines 31. It has been found that such a magnetic key having the pair of magnets which properly align with the metal tines provides increased security than if only a single metal tine and corresponding single magnet were utilized. However, other types of magnetic unlocking key arrangements can be used without affecting the concept of the invention. After the tines have been moved to their unlocked position of FIG. 5, locking plug 27 is pulled easily out of locking channel 38 in the direction of Arrow B (FIG. 6), enabling the cable 3 to be removed from a selected item of merchandise.

Figure 7:
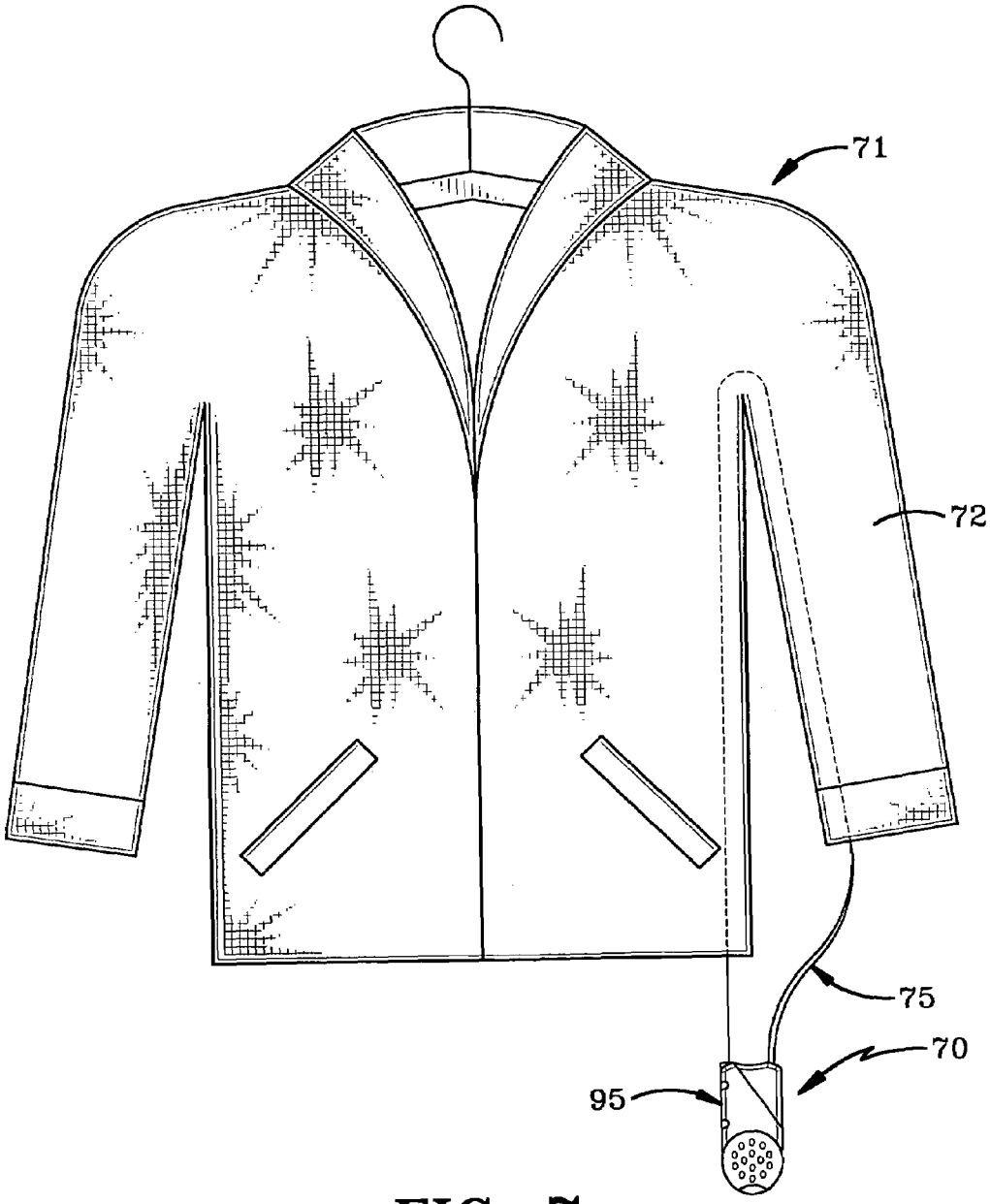
FIG. 7 is a diagrammatic view of a second embodiment of the cable alarm security device extending through the sleeve of an article of clothing.
Figure 8:
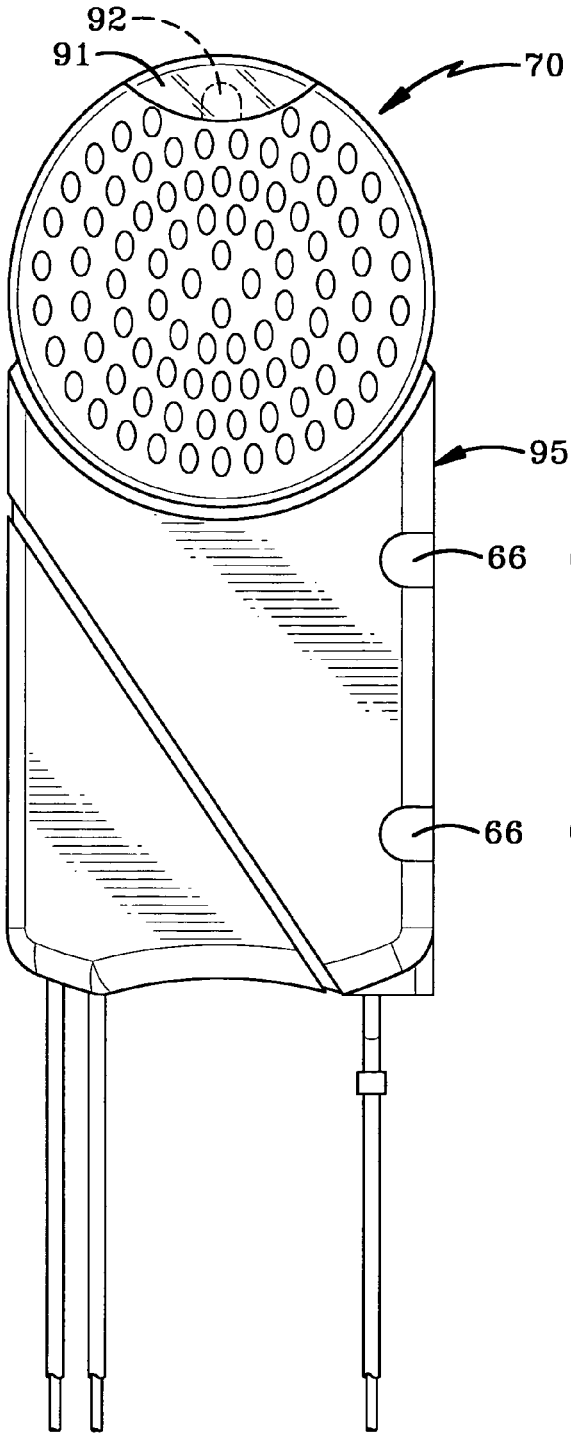
FIG. 8 is a plan view similar to FIG. 1 of the second embodiment of the security device shown in FIG. 7.
Figure 9:
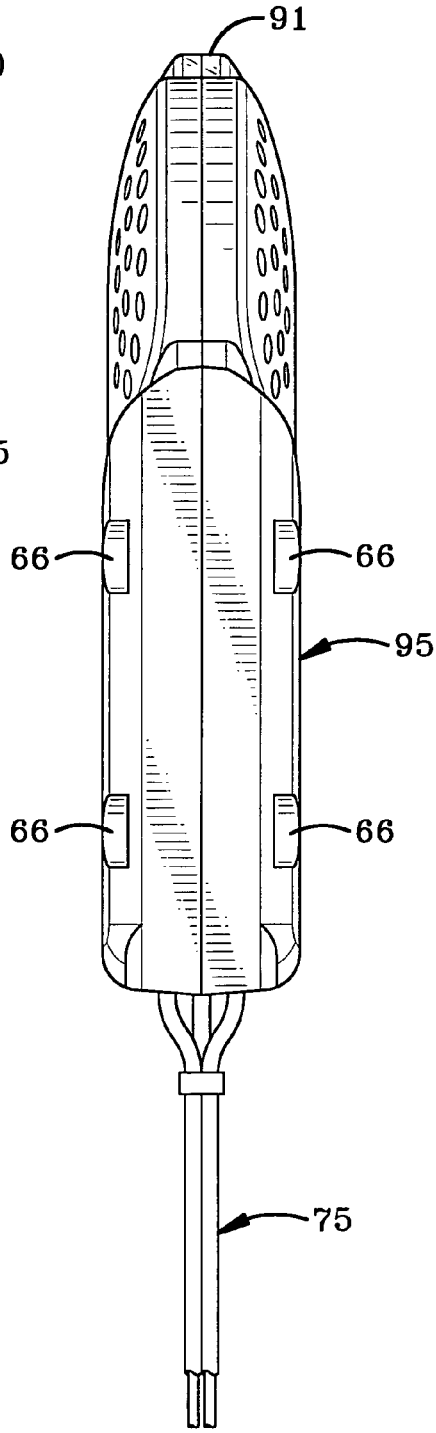
FIG. 9 is a right side elevational view of FIG. 8 with only part of the lock cable being shown therein.

A second embodiment of the cable alarm security device is indicated generally at 70, and is shown in FIG. 7 mounted on an article of clothing 71, and in particular extending through sleeve 72 thereof. Device 1 is shown particularly in FIGS. 8-11 and includes many of the features discussed above with respect to device 1. The security cable indicated generally at 75, is a continuous loop consisting of a single cable having an internal metal conductor 76 surrounded by a dielectric insulation 77, which is connected to locking plug 27 (FIGS. 10 and 11) by extending in a continuous loop 78 through a curved opening 80 formed in the end of plug 27. The two ends 81 and 82 have a barrel-like connector attached thereto, which are seated in a spaced relationship within a pair of compartments 83 and 84, respectively (FIG. 11) formed in housing 2. Connectors 81 and 82 are connected to a circuit board 85 on which are mounted the various capacitors, resistors, and other components for forming an alarm system indicated generally at 86. Plug end 27 is in locking engagement with metal tines 31 in a same manner as discussed above with respect to security device 1.

The main difference between security devices 1 and 70 is the simplicity of alarm system 86 with respect to alarm system 11. Alarm system 86 does not include a plunger switch 44 nor spring metal clip 40 since the two ends of cable 75 are connected directly to circuit board 85 by conductors 87 and 88. This arrangement still provides for a sense loop through cable 75, and if the cable is cut or severed or either ends 81 and 82 separated from the circuit board, it will cause audible alarm 45 to sound, alerting store personnel that a theft is in progress. Another difference between security device 70 and security device 1 is that the outer end wall of the housing is formed with a circular cutout 90 in which is mounted a lens 91 with an LED 92 being located adjacent thereto for shining through lens 91. LED 92 is connected directly to circuit board 85 and preferably emits a blinking light which is visible from either side of the housing 95.

Figure 10:
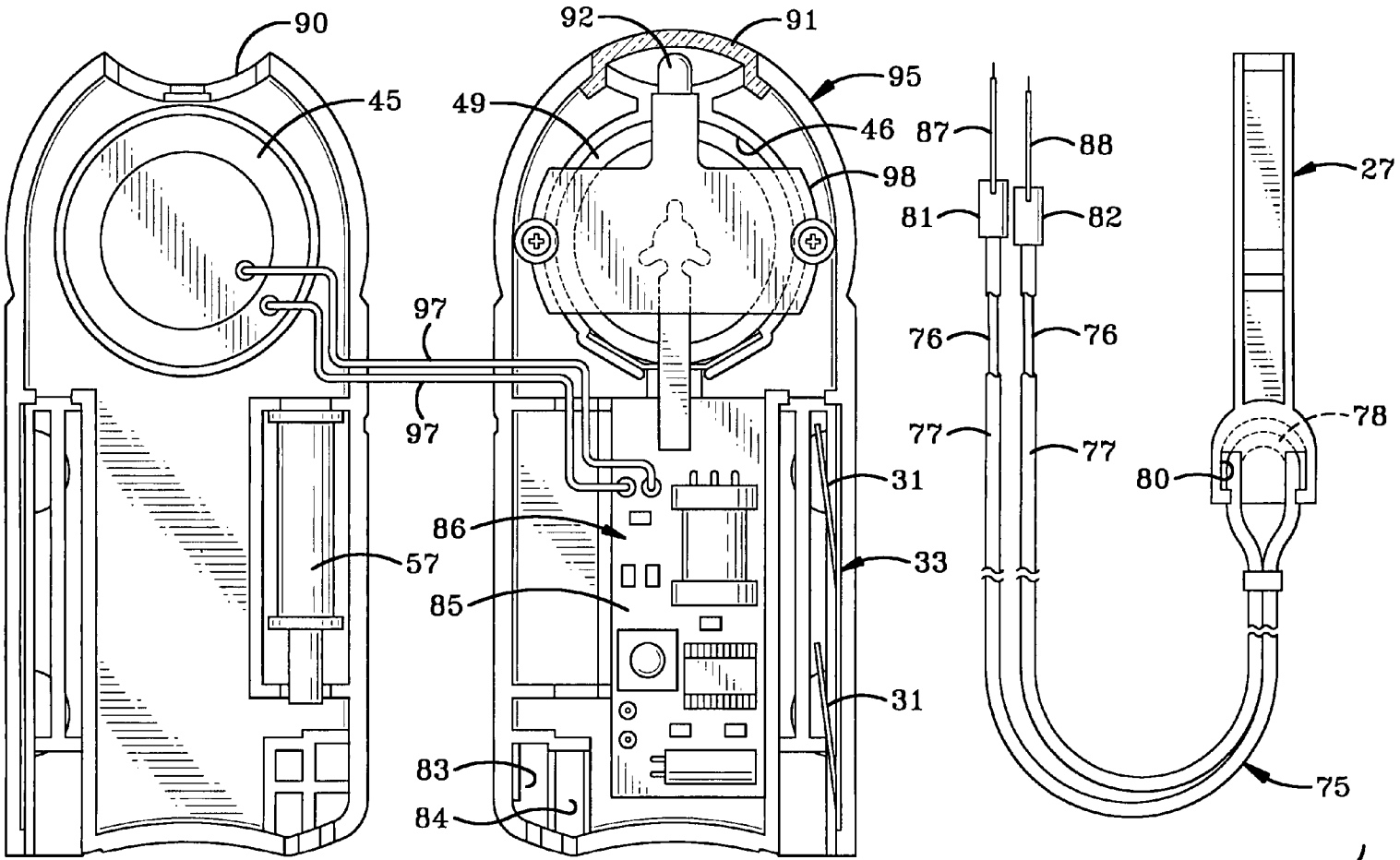
FIG. 10 is an exploded plan view of the security device of FIGS. 7-9 similar to that of FIG. 3.
Figure 11:
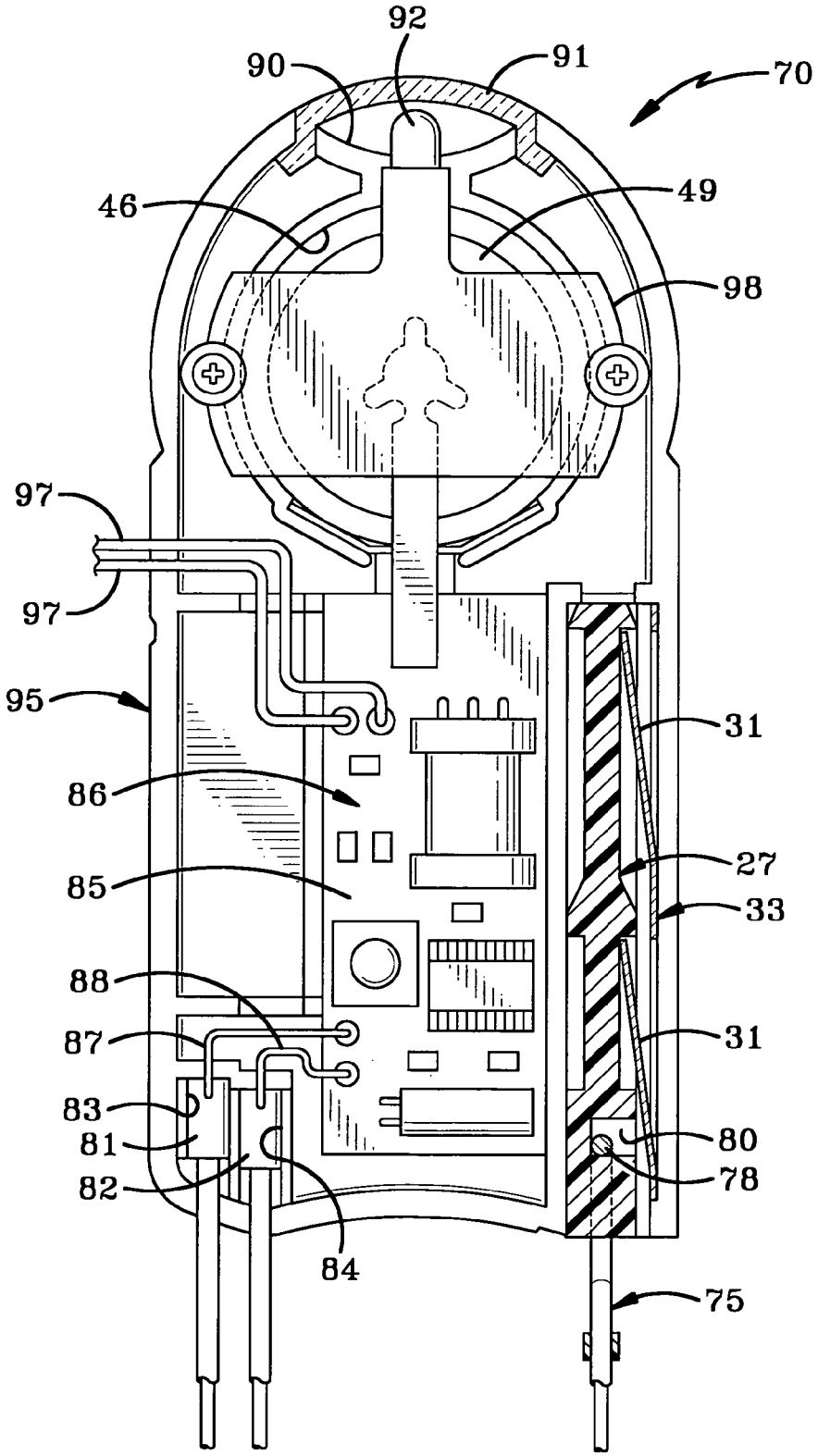
FIG. 11 is a fragmentary view showing the internal locking mechanism and alarm system of the security device of FIGS. 7-10 in a locked position.

As shown in FIGS. 10 and 11, alarm circuit board 85 is connected to alarm 45 by a pair of conductors 97. EAS tag 57 is mounted within housing 95 and will actuate an audible alarm at a security gate upon passing therethrough. The power for alarm system 86 is supplied by self-contained battery 49, which is secured within circular boss 46 by battery cover plate 98. Security device 70 will be a less expensive device than security device 1 due to the less sophisticated alarm system mounted therein which is intended only to sound an alarm if security cable 75 is cut or ends 81 and 82 are forcibly removed from the housing and disconnected from the circuit board. It does not include the more sophisticated and expensive circuitry as discussed above with respect to security device 1 which will sound internal alarm 45 when in proximity to a security gate. However, security device 70 still provides the secure mechanical attachment of the device to an article of merchandise such as shown in FIG. 7, as well as the alarm security feature should someone attempt to remove the security device from the article of merchandise and the security feature of a self-contained EAS tag which will sound a security gate alarm upon passing through a security gate in an unauthorized manner while still attached to the item of merchandise.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device for use with an item of merchandise, said device comprising:

a housing;

a flexible electrically conductive cable having first and second ends, said first end being connected to the housing and the second end being connected to a plug, said plug being an elongated member formed of a dielectric material selectively connectable to and removable from the housing;

a magnetically actuated locking mechanism mounted in the housing engagable with the plug and moveable between locked and unlocked positions to lock the plug to the housing, said locking mechanism including at least one magnetically attractable locking projection engageable with the plug for locking the plug to the housing; and an alarm system mounted within the housing and electrically connected to the first end of the cable and activated when the plug moves into the locked position to sound an audible alarm contained within the housing when the integrity of the cable is compromised.

2. The security device defined in claim 1 wherein only a single electrical conductor extends through the cable and is electrically connected at the first end of the cable to the alarm system, and is electrically connected at the second end of the cable by a metallic terminal mounted thereon which engages a spring contact mounted in the housing and electrically connected to the alarm system.

3. The security device defined in claim 1 wherein a plunger switch is located within the housing and includes a plunger engaged by the plug when moving into the locked position to actuate the plunger switch and activate the alarm system.

4. The security device defined in claim 1 wherein the locking mechanism includes a pair of spring biased magnetically attractable tines; and in which the plug is formed with at least a pair of locking shoulders, each engagable with a respective one of the tines to secure the plug in the locked position.

5. The security device defined in claim 4 wherein the plug has a generally rectangular shape with a pair of opposed sides; and in which two pair of the locking shoulders are formed on the plug, each of the pairs being formed on a respective one of the sides of the plug, whereby said plug is insertable into the housing and for locking engagement with the locking mechanism in two different positions of the plug.

6. The security device defined in claim 1 wherein an LED is mounted in the housing and operatively connected to the alarm system, said LED being located adjacent opposed openings formed on opposite sides of the housing whereby said LED when lighted is visible on both sides of the housing.

7. The security device defined in claim 1 wherein an LED is mounted in an outer end portion of the housing and operatively connected to the alarm system.

8. The security device defined in claim 1 wherein the alarm system includes an audible alarm and an EAS tag located within the housing; and in which the EAS tag is adapted to actuate an audible alarm of a security gate.

9. The security device defined in claim 8 wherein the alarm system includes an audible alarm; and in which the EAS tag actuates said audible alarm when the security device is in proximity to the security gate.

10. The security device defined in claim 1 wherein the cable includes a single electrical conductor extending in a continuous loop starting and ending at the first end of the cable and extending in a continuous manner through the second end.

11. The security device defined in claim 1 wherein the alarm system is powered by a battery located in the housing and connected to said alarm system.

12. The security device defined in claim 1 wherein the housing has a generally elongated relatively flat configuration including a pair of opposed side walls, edge walls and end walls; and in which the plug is slidably inserted into a channel formed in the housing through an opening formed in one of the end walls adjacent one of the edge walls and the first end of the cable being non-removably connected to the housing through said one end wall adjacent the other of said edge walls.

13. The security device defined in claim 12 wherein the other of said end walls has a rounded configuration.

14. The security device defined in claim 13 wherein an LED is mounted in the housing adjacent the rounded end wall of the housing; and in which a lens is mounted in the housing at the rounded end wall whereby said LED is visible from both sides of the housing.

15. The security device defined in claim 13 wherein a perforated area is formed in both of the housing side walls generally adjacent the rounded end wall; and in which the alarm system includes an audible alarm located adjacent said perforated areas.

16. The security device defined in claim 12 wherein the housing includes two half body members generally similar to each other and joined at a seam extending along the edge walls and end walls.

17. The security device defined in claim 1 wherein the magnetically attractable locking projection includes an elongated flat piece of metal having a pair of outwardly extending tines lanced therein, each of said tines engagable with locking shoulders formed on the plug to releasably secure the plug in the locked position.

18. The security device defined in claim 17 in combination with a key for unlocking the locking mechanism, said key containing a pair of spaced magnets, each aligned with a respective one of the metal tines to move said tines out of engagement with the locking shoulders.

19. A security device for use with an item of merchandise, said device comprising:

a housing having a generally elongated relatively flat configuration including a pair of opposed side walls, edge walls and end walls;

a flexible cable having first and second ends, said first end being connected to the housing through one of the end walls adjacent one of the edge walls, and the second end being connected to a plug, said plug being an elongated member formed of a dielectric material and slidably insertable into and from a channel formed in the housing through an opening formed in the said one end wall and located adjacent the other of said edge walls for selectively connecting the plug to the housing;

a magnetically actuated locking mechanism mounted in the housing engagable with the plug and moveable between locked and unlocked positions to lock the plug to the housing; and an alarm system mounted within the housing and electrically connected to the first end of the cable by at least one metal connector seated in a compartment formed in the housing and electrically connected at the second end of the cable to the alarm system by a metallic terminal retained within a compartment formed in the plug to sound an audible alarm contained within the housing when the integrity of the cable is compromised.

20. A security device for use with an item of merchandise, said device comprising:

a housing;

a rigid elongated plug formed of a dielectric material having first and second ends slidably insertable into and from the housing;

a flexible cable having first and second ends, said first end of the cable being connected to the housing and the second end of the cable being connected to the first end of the plug;

an alarm system mounted within the housing and operatively connected to the cable to sound an audible alarm contained within the housing when the integrity of the cable is compromised, said alarm system including a plunger switch having a plunger for activating said plunger switch; and a magnetically actuated locking mechanism mounted in the housing and automatically engageable with the plug to lock the plug to the housing when said plug is slidably insertable into the housing, said second end of the plug being engageable with the plunger when inserted into the housing and locked to the housing to trip said plunger to activate the plunger switch and activate the alarm system.

21. A security device for use with an item of merchandise, said device comprising:

a housing;

a plug selectably slidably insertable into and from the housing;

a flexible cable having first and second ends, said cable including a single electrical conductor extending in a continuous manner starting and ending at the first end of the cable and forming a loop at the second end, said first end being connected to the housing and the second end being connected to the plug by the loop;

an alarm system mounted within the housing and operatively connected to the first end of the cable to sound an audible alarm contained within the housing when the integrity of the cable is compromised; and a magnetically actuated locking mechanism mounted in the housing including at least one magnetically attractable locking member moveable into and out of engagement with the plug to lock the plug to the housing.

22. A security device for use with an item of merchandise, said device comprising:

a housing;

a plug having a pair of opposed sides, each side being formed with at least one locking shoulder formed thereon enabling the plug to be slidably insertable in either of two positions into and from the housing;

a flexible cable having first and second ends, said first end being connected to the housing and the second end being connected to the plug;

an alarm system mounted within the housing and operatively connected to the cable to sound an audible alarm contained within the housing when the integrity of the cable is compromised; and a magnetically actuated locking mechanism including at least one magnetically attractable tine mounted in the housing, said locking tine being automatically engageable with one of the locking shoulders of the plug to lock the plug to the housing when said plug is slidably insertable into the housing in either one of the two different positions.

* * * * *